United States Patent [19]

Kato et al.

[11] 4,299,108

[45] Nov. 10, 1981

[54] CAGE-ROLL UNIT FOR METAL PIPE FORMING

[75] Inventors: Masashi Kato; Hirozo Obata; Minoru Hirata, all of Kitakyushu; Hitoshi Matsukuma; Kunio Ishikawa, both of Hikari; Junichi Tanaka, Kitakyushu, all of Japan

[73] Assignee: Nippon Steel Corporation, Tokyo, Japan

[21] Appl. No.: 72,844

[22] Filed: Sep. 6, 1979

[30] Foreign Application Priority Data

Sep. 12, 1978 [JP] Japan ..... 53-124323[U]

[51] Int. Cl.[3] ..... B21D 5/08; B21D 51/00; B21D 39/00

[52] U.S. Cl. ..... 72/178; 72/52; 72/181; 228/17; 228/147; 228/151

[58] Field of Search ..... 72/51, 52, 178, 179, 72/181, 182; 228/17 R, 17.5, 146, 147, 151, 148

[56] References Cited

U.S. PATENT DOCUMENTS

| | | | |
|---|---|---|---|
| 2,098,989 | 11/1937 | Yoder | 228/151 |
| 2,203,855 | 6/1940 | Anderson | 228/17.5 X |
| 2,471,490 | 5/1949 | Mercer | 72/181 |
| 3,472,053 | 10/1969 | Chang | 72/178 |
| 4,070,887 | 1/1978 | Hankin | 72/52 |
| 4,122,696 | 10/1978 | Midzutani et al. | 72/52 |

FOREIGN PATENT DOCUMENTS

| | | | |
|---|---|---|---|
| 1924960 | 11/1970 | Fed. Rep. of Germany | 72/52 |
| 950719 | 2/1964 | United Kingdom | 72/178 |
| 1283951 | 8/1972 | United Kingdom | 72/52 |

*Primary Examiner*—Ervin M. Combs
*Attorney, Agent, or Firm*—Wenderoth, Lind & Ponack

[57] ABSTRACT

A metal pipe forming mill progressively forms a flat metal sheet into a circular form along the mill axis by forming rolls including pairs of cage rolls. A cage-roll unit in this type of mill has a pair of movable bases disposed on both sides of the mill axis, with the space between the two movable bases being freely adjustable, and a pair of stands mounted on the movable bases, one on each. The stands rotatably support, on their surfaces facing the mill axis, two or more pairs of cage rolls, one pair following another along the mill line.

6 Claims, 5 Drawing Figures

CAGE-ROLL UNIT FOR METAL PIPE FORMING

BACKGROUND OF THE INVENTION

This invention relates to a cage-roll unit for use in a welded metal pipe forming mill.

Known methods of continuously forming metal sheet, such as steel strip, into a cylindrical form as a step for manufacturing steel pipe include step roll forming which carries out stepwise forming of the strip combining horizontal top and bottom rolls and vertical side rolls and cage-roll forming which comprises pre-forming into an arc having an approximately uniform curvature throughout its entirety by horizontal, curved top and bottom rolls, then forming the edges by edge-forming rolls.

Pipe forming mills based on these known methods, especially those of the side-roll type, each have vertical shafts on both sides of bottom rolls that form a plane along which the piece is threaded, with side rolls rotatably carried by the shafts to deform the piece from both sides.

The side- and other rolls used for shaping the flat piece into a round form have grooves, which define shapes among each set of rolls which are known as passes, designed in accordance with the diameter of pipe to be manufactured. When the pipe diameter is changed from one to another, the rolls are changed to those which form passes suited for the latter, with the roll spaces accordingly adjusted.

Each side-roll unit of this type has a pair of vertical shafts which carry replaceable rolls of different diameters, from rather large ones to small ones. In terms of the outside diameter of the pipe, the largest one is 3 to 4 times larger than the smallest one. (In the case of medium-size pipe, the diameter ranges from 8 inches minimum to 24 inches maximum.) As will be understood, intervals at which the side-roll units are positioned along the mill axis must be large enough to accommodate the side rolls for the largest-diameter pipe. Therefore, when the side rolls are changed to those for the smallest-diameter pipe, with the intervals of the side-roll units unchanged, excess space is left between the side rolls. Unless such excess space which exists during the small-diameter pipe forming is filled, poor threading or excessive stepped forming might result, entailing twisting or deformation of product pipe.

It is conceivable to replace some of the side rolls with many cage rolls, in an attempt to manufacture good-shaped pipes over a wide diameter range by the step roll forming method. But a cage-roll unit occupies a larger space than a side-roll unit in the direction of the mill axis. For example, a cage-roll forming mill is approximately 1.5 times longer than a step roll forming mill. Accordingly, it is difficult to replace part or all of the side-roll units in an existing step roll forming mill with cage-roll units of the conventional type.

When the diameter of pipe to be manufactured changes, the space between the side rolls on both sides of the mill axis must be ajusted accordingly. This space adjustment is relatively easy with the side-roll unit as compared with the cage-roll unit. Therefore, if the side-roll and cage-roll units are used selectively for the desired pipe diameters, production efficiency can be increased without marring the form of product pipe. To permit this, the two units must be readily interchangeable.

U.S. Pat. No. 3,472,053 exemplifies a cage-roll mill of the conventional design, with many cage-roll units, each carrying a pair of cage rolls, disposed along the mill axis.

SUMMARY OF THE INVENTION

This invention is intended for obviating the above-described difficulties with the metal pipe forming mills.

An object of this invention is to provide a cage-roll unit for metal pipe forming that permits forming good-shaped pipes even when the diameter of pipe to be manufactured changes, without leaving excess space between the adjacent forming rolls disposed along the mill axis.

Another object of this invention is to provide a cage-roll unit for metal pipe forming that permits modifying an existing step roll forming mill into one incorporating a cage-roll unit or units, and which is readily interchangeable with a side-roll unit depending on the diameter of pipe to be manufactured.

To achieve the above objects, a cage-roll unit according to this invention, which constitutes an element of a metal pipe forming mill that progressively forms a flat metal sheet into a circular form along the mill axis by forming rolls including pairs of cage rolls, comprises a pair of movable bases disposed on both sides of the mill axis, with the space between the two movable bases being freely adjustable, and a pair of stands mounted on the movable bases, one on each. The stands rotatably support, on their surfaces facing the mill axis, two or more pairs of cage rolls, one pair following another along the mill line.

Because of these characteristics, cage rolls according to this invention can be spaced at short intervals. Besides, relatively small-diameter rolls are used. Therefore, the units for large-diameter pipes can be installed within the same space as for small-diameter pipes, without decreasing the number of forming steps. Conversely, the number of forming steps can be increased within a limited space, which permits smoother forming.

DETAILED DESCRIPTION OF THE PREFERRED EMBODIMENTS

Now this invention will be described in detail by reference to the accompanying drawings.

Figure 1:
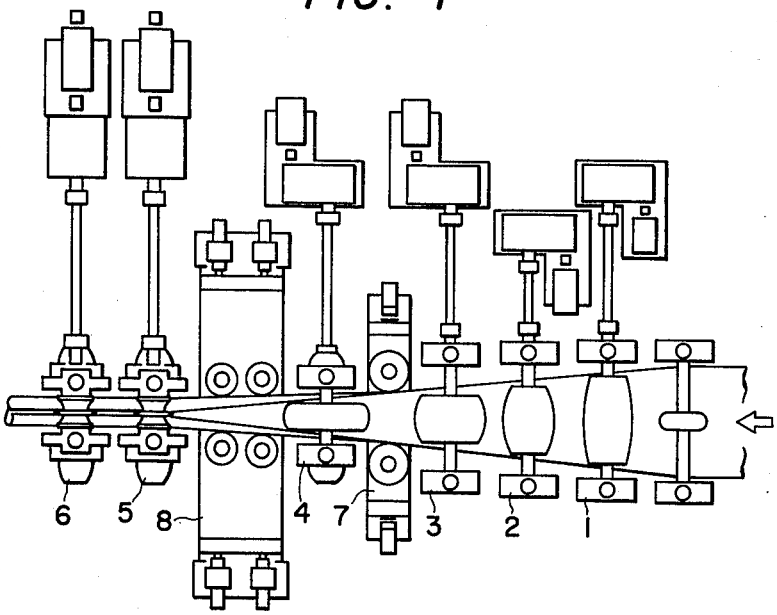
FIG. 1 shows a cage-roll type pipe forming mill train incorporating cage-roll units according to this invention.

FIG. 1 shows an example of a pipe forming mill of the step roll forming type. Reference numerals 1, 2, 3 and 4 designate horizontal forming stands spaced at suitable intervals, each comprising a bottom horizontal roll with a pass and a top horizontal forming roll paired with the bottom horizontal roll. Reference numerals 5 and 6 denote fin pass stands, each comprising a top horizontal finned roll with a pass and a bottom roll. Items 7 and 8 are cage-roll units according to this invention, which are generally positioned midway in the forming line, although there positions are by no means limited thereto.

Figure 2:
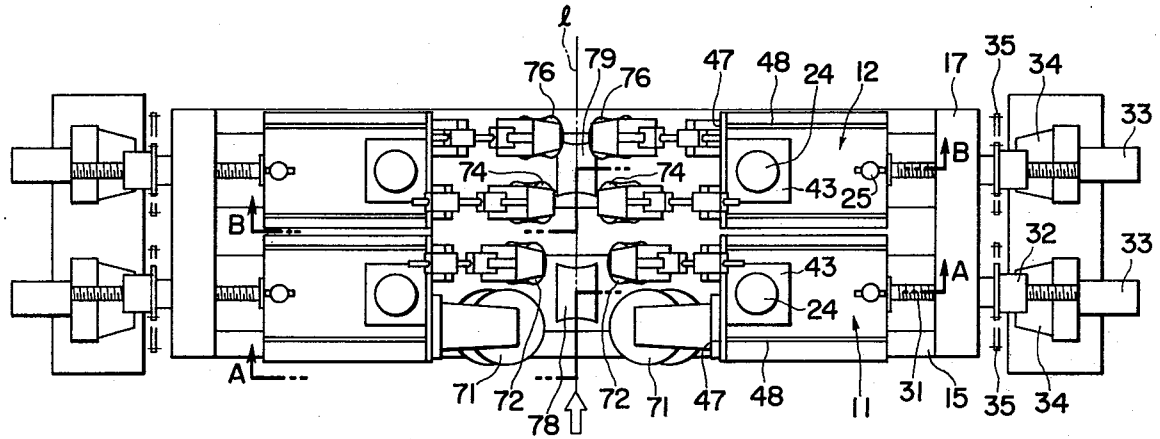
FIG. 2 is a plan view of an embodiment combining two cage-roll units of this invention positioned next to each other.
Figure 3:
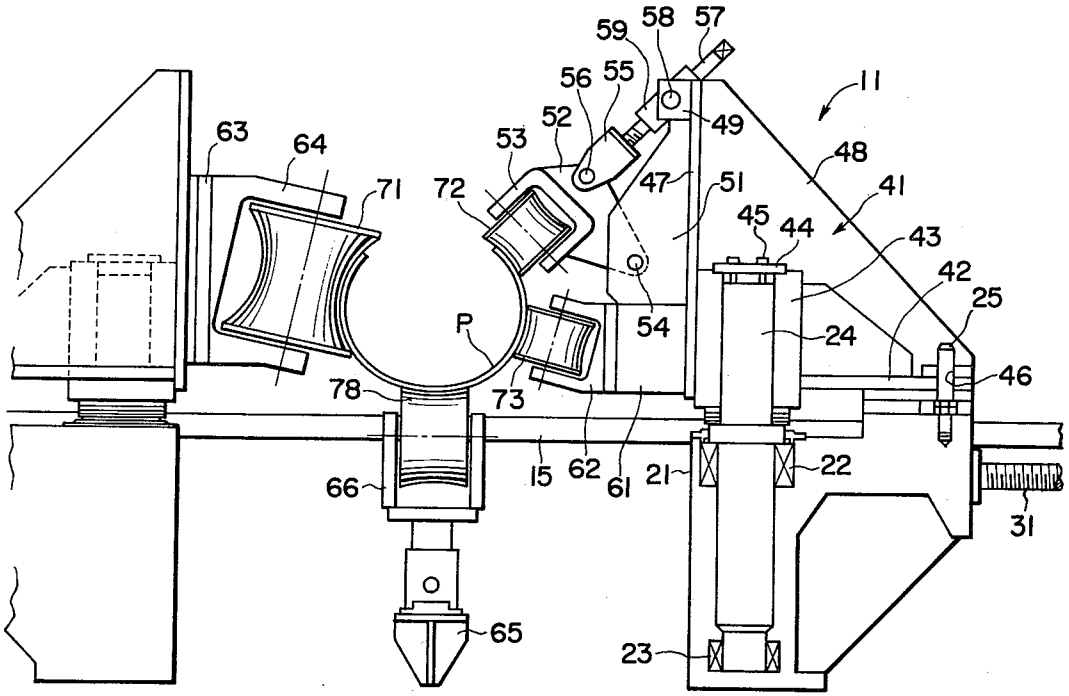
FIG. 3 is an elevation viewed in the direction A—A in FIG. 2.
Figure 4:
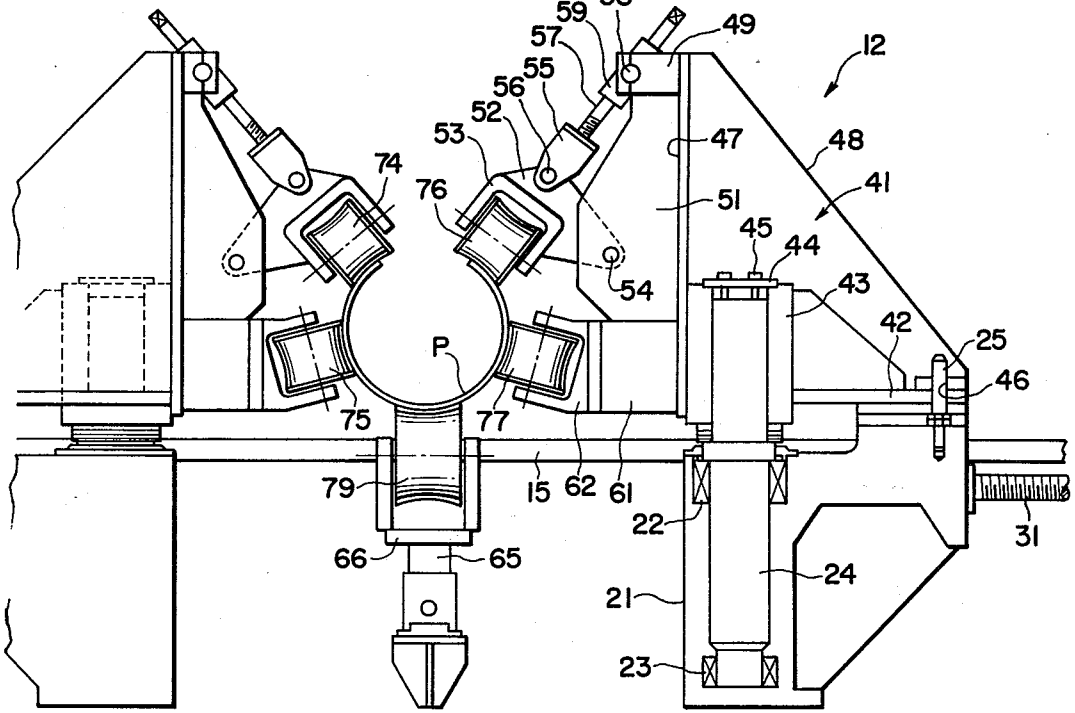
FIG. 4 is an elevation viewed in the direction B—B in FIG. 2.

FIGS. 2 through 4 show embodiments of the cage-roll unit of this invention. FIG. 2 shows two cage-roll units 11 and 12, which are identical with each other, except for the cage rolls and supporting means thereof. Similar reference numerals designate similar parts throughout these figures.

As illustrated, the cage-roll units 11 and 12 each have a cross rail 15 that crosses the mill line l, extending below the piece P being formed.

The cross rail 15 supports thereon a pair of movable bases 21 disposed on both sides of the mill line l so as to be movable back and forth along the cross rail 15. To the rear of the movable base 21 is fixed a rearwardly extending, threaded working shaft 31, which fits in a threaded sleeve 32 rotatably supported by a support 17 at the most extreme end of the cross rail 15. The threaded sleeve 32 is driven by a motor 33 through a reduction gear 34 and a chain 35. The rotation of the threaded sleeve 32 moves the working shaft 31 back and forth and, consequently, moves the movable base 21 back and forth along the cross rail 15. The mechanism for thus moving the movable base 21 is not limited to the above-described one, but may comprise a rack mechanism, a hydraulic cylinder, etc.

A vertical shaft 24 is supported upright in bearings 22 and 23 near the front end of the movable base 21, with the upper half of the vertical shaft 24 protruding above the top surface of the movable base 21. This vertical shaft 24 fastens a stand 41 onto the movable base 21. Namely, a vertical sleeve 43 at the front end of a base plate 42 of the stand 41 is fitted over the projecting portion of the vertical shaft 24, then the tops of the vertical shaft 24 and sleeve 43 are fastened together by a fixing plate 44 and a screw 45. A pin hole 46 in the base plate 42 is fitted over an upwardly projecting pin 25 at the rear end of the movable base 21, whereby the stand 41 is fixed on the movable base 21. By being thus fixed, the stand 41 is not allowed to rotate about the vertical shaft 24. By removing the fixing plate 44 and pin 25, the stand 41 can be readily detached from the movable base 21, whereby a side roll (not shown) can be rotatably mounted on the vertical shaft 24. This provides a choice between using a side roll and or a cage roll, depending on the diameter of pipe to be manufactured. Because the stand 41 or a side roll is mounted on the vertical shaft 24 or directly, alignment of the cage roll or side roll can be accomplished easily.

A front plate 47 stands upright in front of the base plate 42 of the stand 41, facing the mill line l. A side plate 48 for supporting and reinforcing the front plate 47 is fastened to each end of the front plate 47. A bracket 51, fastened to the front plate 47, swingably supports, on a pin 54, an arm 52 with a U-shaped roll support 53. A connecting member 55 is swingably attached to the front part of the arm 52 by a pin 56. To the connecting member 55 is coupled the front end of an adjusting screw 57 which is rotatable about the axis thereof. A bracket 49 is fastened to the top of the front plate 47 of the stand 41. The bracket 49 has a pin 58 which swingably supports 41. The bracket 49 swingably supports, through a pin 58, a sleeve 59 that receives the adjusting screw 57. By rotating the adjusting screw 57 in and out, the arm 52 is swung up and down about the pin 54.

In the cage-roll unit 11, the roll support 53 on the arm 52 rotatably carries a cage roll 72 with a concave surface the curvature of which is identical with that of the piece P being formed. The cage roll 72 presses, slanting downwardly from above, the edges of the piece P, toward the round shape, toward the center thereof.

An arm 61 with a U-shaped roll support 62 is fastened to the front plate 47 below the bracket 51. The roll support 62 has rotatably mounted thereon a cage roll 73 of the same shape as the upper cage roll 72. This lower cage roll 73 presses, slanting upwardly from below, the external surface of the piece P being formed toward the center thereof.

Likewise, the cage-roll unit 12 carries cage rolls 74, 75, 76 and 77.

As described above, the cage rolls are provided at two positions, high and low, so that they contact the external surface of the piece being formed, slanting from above and below.

When a cage-roll unit of this invention and a forming stand upstream thereof are relatively widely spaced, the semi-formed piece entering the cage-roll unit might have the head end expanded beyond the limit of the first roll pass on the forming stand due to springback or other reasons. To prevent the occurrence of such troubles as the striking of the piece against the cage rolls, an upstream-end cage roll 71, shown at the left of FIG. 3, of the cage-roll unit immediately following the forming stand may be replaced with a grooved roll that is adapted to come in substantial contact with the external surface of the piece being formed. The aforesaid threading trouble can be avoided by, for example, making the bottom diameter of the cage roll 71 at the bottom of the groove larger than that of the following cage rolls 72 and 73.

The cage roll 71 is larger than the cage rolls 72 and 73, in both body length and diameter at the bottom of the groove. A U-shaped roll support 64 on an arm 63 fixed to the front plate 47 rotatably carries a single such cage roll 71. The cage roll 71 contacts the external surface of the piece P being formed, covering approximately one-third of the arc thereof.

Each cage-roll unit carries two pairs of cage rolls, one following the other along the mill line. More precisely, the cage-roll unit 11 carries the cage rolls 71 and 72, or 71 and 73, and the cage-roll unit 12 carries the cage rolls 74 and 76, or 75 and 77, adjacent to each other along the mill line l. A pair of cage rolls 71 is provided, one on each side of the mill line l. The other rolls 72 through 77 are in similar piars not only transversely to the mill line, but also vertically.

The cage-roll units 11 and 12 each have support rolls 78 and 79, respectively, to support the piece P being formed from below. The support rolls 78 and 79 each have a concave surface the curvature in which is identical with that of the piece P, and is rotatably supported by a U-shaped roll support 66 on a roll stand 65. The roll stand 65 has an elevating mechanism (not shown) that moves the roll support 66 up and down in accordance with the diameter of pipe to be manufactured.

In the above-described embodiment, the bottom cage rolls are fixed to the stand 41. But the bottom cage rolls may be attached in the same manner as the top cage rolls. In such case, the arm 61 is pinned to a swingable arm, which is, in turn, connected to an adjusting screw, so that a cage roll carried thereby can be adjusted so as to come into contact with the external surface of the piece being formed. The cage rolls adjustably attached to the stand 41 are very convenient, being capable of coping with a change in the pipe diameter with ease.

A single cage-roll unit of this invention as described above or two or more such units in tandem can be installed midway in a pipe forming mill train singly, or with two or more units in tandem. Before threading the piece P into the unit or units, the space between the pairs of the cage rolls 71 through 77 which are opposite to each other is adjusted about the support roll 78 so that the cage rolls 71 through 77 come in contact with the external surface of the piece being formed at their respective position by actuating the working shaft 32, and the adjusting screw 57, too, as required.

Figure 5:
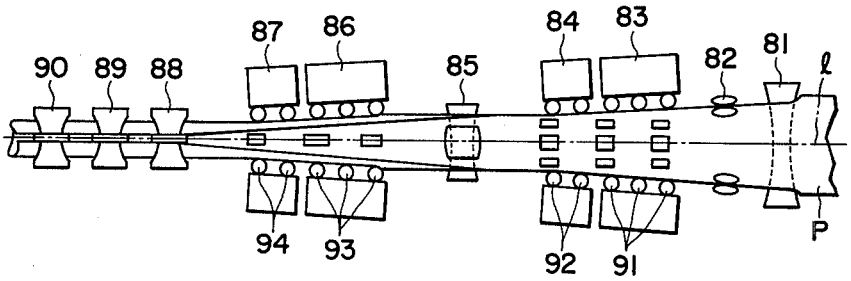
FIG. 5 schematically shows another example of a cage-roll type pipe forming mill train incorporating more cage-roll units of this invention.

FIG. 5 shows another example of a mill train to which the cage-roll unit of this invention is applied. This metal pipe forming mill train comprises a pair of pre-forming rolls 81, a pair of edge-forming rolls 82, cage-roll units 83 and 84, a pair of intermediate-forming rolls 85, cage-roll units 86 and 87, and finish-forming fin rolls 88, 89 and 90. The cage-roll units 83 and 86 each have three pairs of cage rolls 91 and 93 along the mill line l, while the cage-roll units 84 and 87 each have two pairs of cage rolls 92 and 94. As is evident, the cage-roll unit of this invention is not limited to the embodiment of FIG. 2 which has two pairs of cage rolls. The number of cage roll pairs may be three, as shown in FIG. 5, or more.

What is claimed is:

1. A cage roll unit for use in a metal pipe forming mill train for progressively forming a flat metal sheet into a round form along a mill line extending along the mill train by means of forming rolls, said cage roll unit comprising:

a cross rail extending perpendicular to the mill line;

a pair of movable bases slidably supported on said cross rail so as to be slidable therealong, one on each side of the mill line;

driving mechanisms connected to said bases for moving said bases back and forth along said cross rail;

a pair of stands, one mounted on each movable base;

at least two pairs of cage rolls rotatably mounted on said stands and facing said mill line and defining a pass for the metal sheet being formed, one pair on each side of said mill line, each pair having an upper and a lower cage roll, the corresponding cage rolls on each stand being opposed to each other, said lower cage rolls having a curved profile opening upwardly and inwardly toward the center of the pass and the upper cage rolls having a curved profile opening downwardly and inwardly toward the center of the pass, at least the upper cage rolls being mounted on said stands for pivoting movement about an axis parallel to said mill line for adjusting the position of said upper cage rolls relative to the center of the pass; and a support roll rotatably disposed between the stands for supporting the metal sheet being formed from below.

2. A cage roll unit as claimed in claim 1 in which said lower cage rolls are also mounted on said stands for pivoting movement about an axis parallel to said mill line for adjusting the position of said lower cage rolls relative to the center of the pass.

3. A cage roll unit as claimed in claim 1 in which there are four pairs of cage rolls on said stands, two pair on each side of said mill line, one pair on each stand being spaced along the mill line from the other pair.

4. A cage roll unit as claimed in claim 1 further comprising a single large cage roll on each stand, the pair of cage rolls in each stand being spaced along said mill line from the single large cage roll.

5. A cage roll unit as claimed in claim 1 in which each stand is removably mounted on the corresponding base, said base having a vertical shaft projecting upwardly therefrom and said stand having a sleeve thereon which fits over said vertical shaft.

6. A cage roll unit as claimed in claim 5 further comprising a pin between the base and the stand for preventing the stand from rotating around the vertical shaft on the base.

* * * * *